United States Patent [19]

Ackerman

[11] Patent Number: 5,070,919

[45] Date of Patent: Dec. 10, 1991

[54] ROTARY CUTTERS FOR RING DEBARKERS

[75] Inventor: Robert T. Ackerman, Seattle, Wash.

[73] Assignee: Nicholson Manufacturing Company, Seattle, Wash.

[21] Appl. No.: 640,055

[22] Filed: Jan. 11, 1991

[51] Int. Cl.[5] ..... B27L 1/00; B27G 13/00

[52] U.S. Cl. ..... 144/208 E; 144/230; 144/341; 407/49

[58] Field of Search ..... 144/218, 230, 208 R, 144/208 E, 341; 407/49, 45, 41, 46, 51, 58, 113

[56] References Cited

U.S. PATENT DOCUMENTS

| | | | |
|---|---|---|---|
| 3,587,150 | 6/1971 | Menard | 407/49 |
| 3,672,017 | 6/1972 | Nielsen et al. | 407/49 |
| 3,789,893 | 2/1974 | Carson et al. | 144/208 E |
| 4,303,111 | 12/1981 | Neville | 144/208 E |
| 4,819,703 | 4/1989 | Rice et al. | 144/230 |

*Primary Examiner*—W. Donald Bray
*Attorney, Agent, or Firm*—Seed and Berry

[57] ABSTRACT

Rotary cutters for ringer debarkers each have multiple cutter units secured together in coaxial staggered relation. Each cutter unit has gullets between gauge lands, and has knives in the gullets clamped against the leading side of the lands by wedging keys secured in the gullets. The staggering of the cutter units provides each knife with a gauge land on one of the other units for cutting depth control.

7 Claims, 3 Drawing Sheets

ROTARY CUTTERS FOR RING DEBARKERS

TECHNICAL FIELD

The present invention relates to rotary cutters for use on the swing arms of ring debarkers to remove bark from logs fed through the debarker ring.

BACKGROUND OF THE INVENTION

Rotary cutters have been used on ring debarkers for debarking logs of a wood species having relatively long, stringy fibers such as cedar.

However, heretofore such cutters have had multiple cutting blades extending along the cutter body and advancing spirally, from end to end. Such blades are difficult to machine, mount and sharpen, and have a relatively short life between sharpenings. Also, it is difficult to control the depth of cut of the blades.

The present invention aims to provide an improved debarking cutter of simplified construction which has a relatively long cutting life and has easily replaced knives having more than one cutting edge which can be used by repositioning the knives.

SUMMARY OF THE INVENTION

In accordance with the present invention, rotary cutter units are provided each having a cylindrical body interrupted at regular intervals around its circumference by gullets defining gauge lands therebetween. Carbide knives are seated on shoulders at the trailing side of the gullets and are clamped against the trailing face of the gullets by wedging keys seated in the gullets between the knives and the leading side of the gullets. Radial bolts secure the wedging keys to the cutter body.

Two or more of the cutter units are secured together end-to-end in coaxial staggered relationship so that each land controls the depth of cut of the knife on one of the other cutter units. To accomplish this, the cutter units are arranged so that at least a portion of each land is located axially of one of the knives on one of the other cutter units.

DETAILED DESCRIPTION OF THE INVENTION

Figure 1:
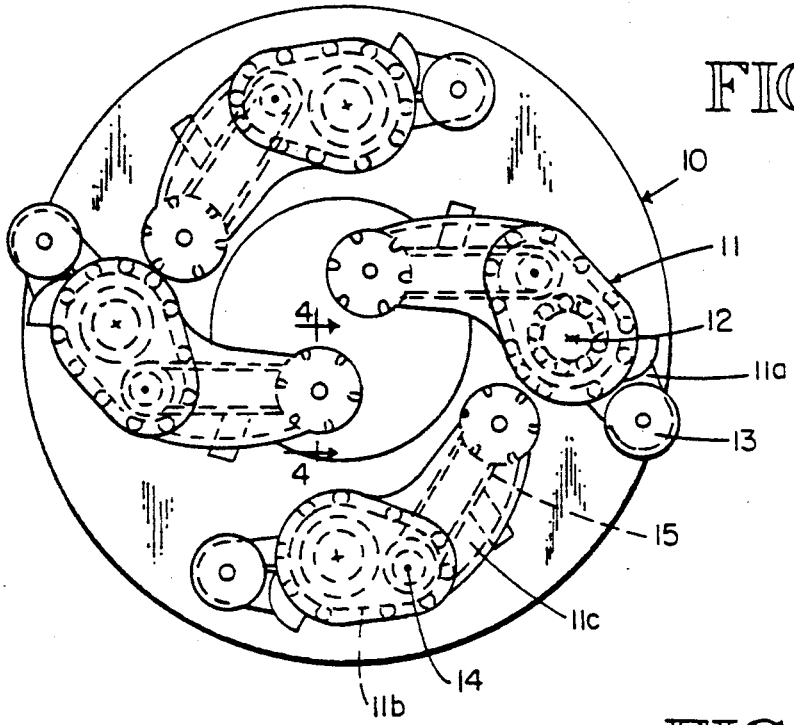
FIG. 1 is a front elevational view of the ring of a ring debarker equipped with rotary cutters embodying the present invention.

Referring to FIG. 1, the ring 10 of a ring debarker is shown, on which swing arms 11 are swing-mounted on hollow pivot shafts centered at the swing axis 12 to move inwardly toward a log conveyed through the ring. Conventionally, the swinging may be controlled in opposition to centrifugal force by air cylinder assemblies extending between pivotal connections on the ring and cranks on the hollow pivot shafts.

Figure 4:
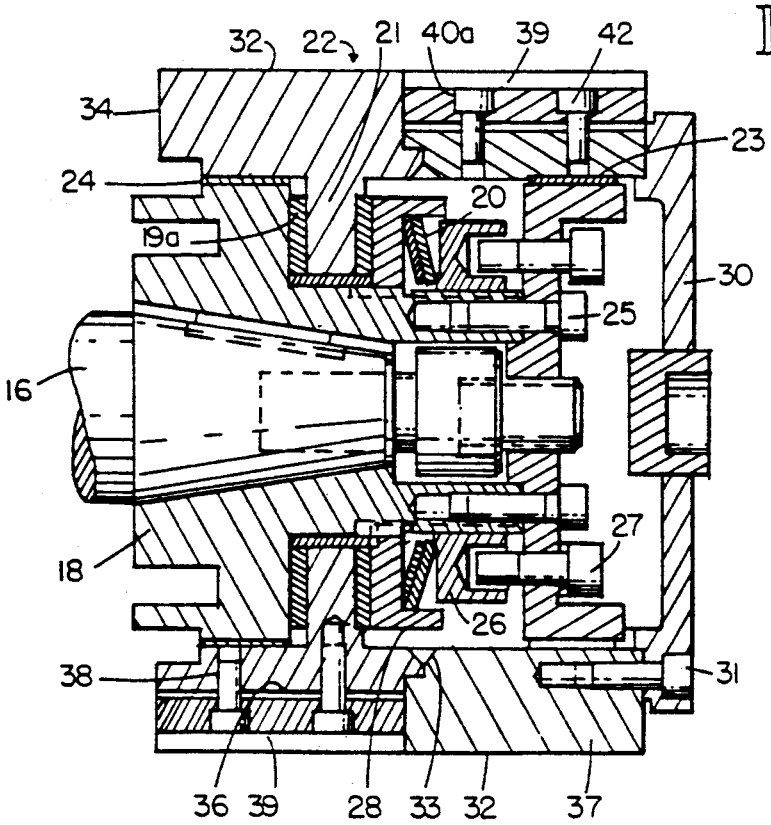
FIG. 4 is a transverse sectional view of one of the rotary cutters taken as shown in FIG. 1.

Preferably, counterweights 13 are mounted on arm extensions 11*a* to be positioned oppositely of the swing axis 12 from the working end of the arms. Not shown is a stationary sun gear mounted coaxially with the debarker ring 10 and meshing with planet gears traveling around the sun gear on respective drive shafts extending through the pivot shafts on which the arms are swing-mounted. A gear is fixed on each of these drive shafts in an inner housing section 11*b* of the arms 11 and meshes with an idler gear on an intermediate shaft centered at 14 which also carries a sprocket for a chain 15 extending in an outer arm housing section 12*c* to an outer sprocket on a stub shaft 16 which projects away from the ring 10 from the respective swing arm. This stub shaft is tapered and keyed to a two-piece hub 18 (FIG. 4) which has a slip clutch mechanism with opposed annular clutch plates 19, 19*a* urged toward one another by spring washers 20. The clutch plates engage the faces of an annular flange 21 projecting inwardly from the rotary cutter assemblies 22 to which this invention is directed.

Each cutter assembly 22 is journaled on bushings 23, 24 on the hub 18. The two pieces of the hub are connected together by bolts 25. Loading of the spring washers 20 is controlled by a screw ring 26 which can be locked in position by bolts 27. The spring washers 20 are seated between the screw ring 26 and a slide ring 28 engaging the clutch plate 19. The inner edges of the clutch plates 19, 19*a* engage a bushing 29. Removable outer cover plates 30 are mounted by bolts 31 on the outer end of the rotary cutter assemblies 22.

The present invention provides improved such cutter assemblies 22, each comprising multiple coaxial cutter units 32, welded together at 33, in end-to-end relation. Each cutter unit 32 has a generally cylindrical body 34 which is circumferentially interrupted at regular intervals by outer longitudinal gullets 36 each having a leading side face 36*a*, a trailing side face 36*b*, and a bottom face 36*c*. The gullets 36 define gauge lands 37 therebetween, which may have the same width, circumferentially of the body 34, as the gullets have between their leading and trailing faces. The bottom face 36*c* of each gullet is stepped adjoining its trailing side face 36*b* to provide a knife seat 36*d*, and the leading and trailing side faces 36*a*, 36*b* diverge outward toward the circumference of the body 34. A pair of threaded bolt holes 38 extends radially inward from the bottom of each gullet 36.

Carbide knives 39 with a rectangular cross section are provided having one longitudinal edge bearing against the seats 36*d* and having their trailing face clamped against the trailing faces 36*b* of the gullets by wedging keys 40. These keys are tapered to match the slope of the leading and trailing gullet faces 36*a*, 36*b*, and have counterbored holes 40*a* registering with the bolt holes 38 in the cutter body 34. The thickness of the keys 40 is less than the depth of the gullets 36 so that when the keys 40 are in operative position, bearing against the leading faces of the knives 39 to clamp the knives against the trailing side faces 36*b* of the gullets 36, a gullet zone 36*z* remains exposed radially outward from the keys 40. Bolts 42 extend through the counterbored holes 40*a* in the keys 40 and are threaded into the registering holes 38. The leading faces of the knives 39 may be radial to the cutter body 34, and their outer leading edges constitute the cutting edges 39*a* of the knives. These cutting edges 39*a* may be slightly radial beyond the circumference of the cutter body 34 at the gauge lands 37.

Figure 2:
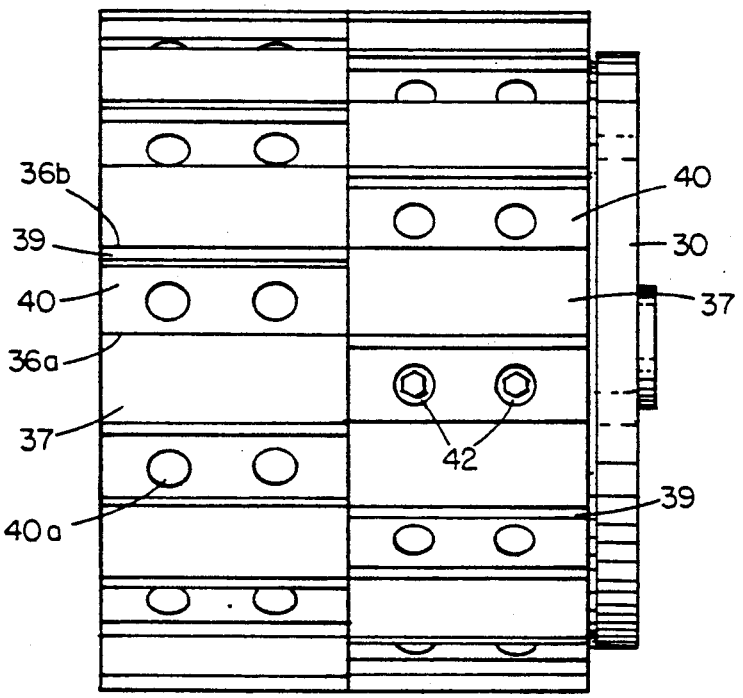
FIG. 2 is a side elevational view of one of the rotary cutters shown before application of most of the hold-down bolts for the wedging keys.
Figure 3:
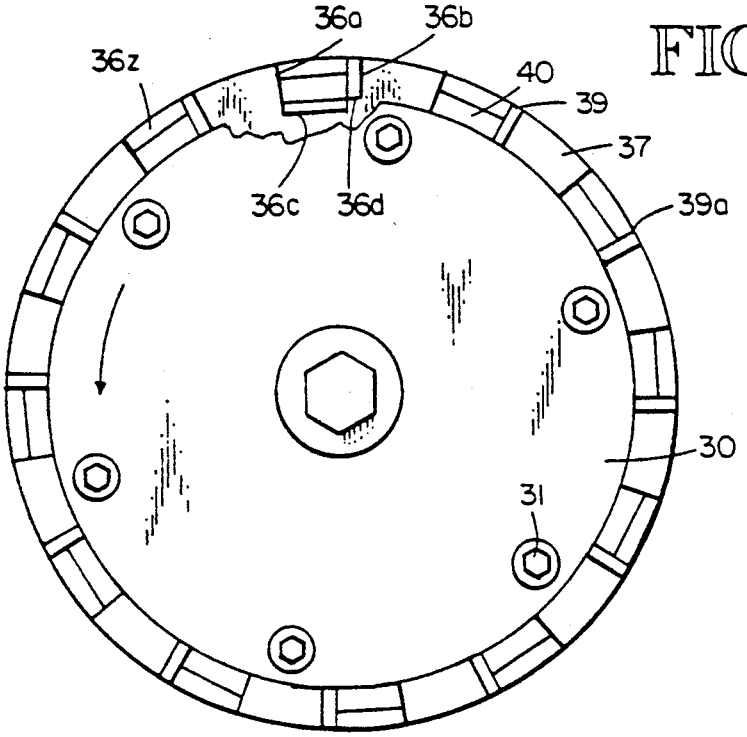
FIG. 3 is an end view of the rotary cutter with part of the cover plate broken away.

In accordance with the present invention, the bodies 34 of two or more of the cutter units are fixed together in staggered end-to-end relation The staggering is such that a portion of each gauge land 37 is located directly endwise to a knife 39 in one of the other cutter units, so that the gauge lands 37 control the depth of cut of the knives 39. For example, when two cutter units are used as shown in FIG. 2, the gullets 36 of each unit are directly endwise to the lands 37 of the other. This arrangement locates the carbide knives 39 in each cutter unit directly endwise to the trailing portion of the lands 37 of the other cutter unit. With this arrangement, the lands 37 control the depth of cut of the directly opposite knives 39.

Figure 5:
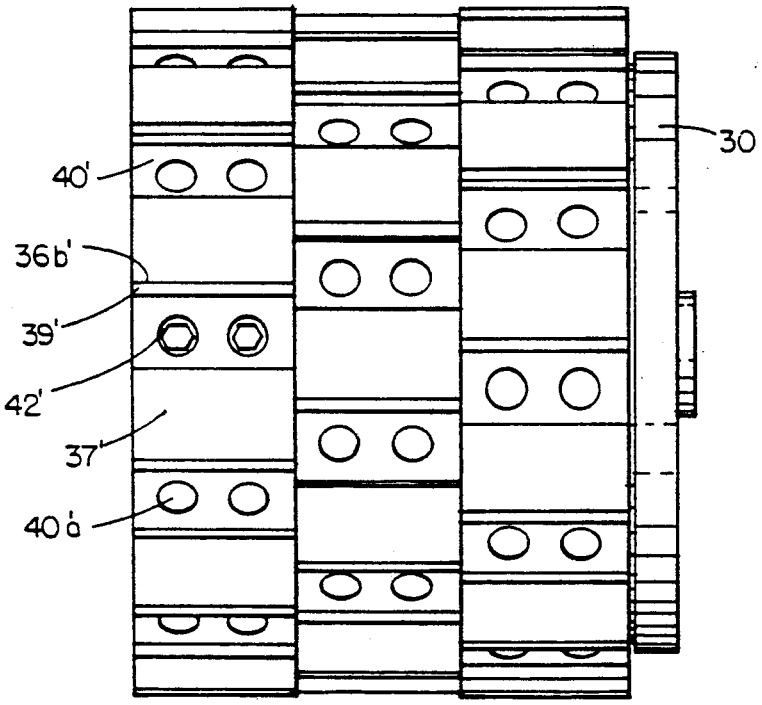
FIG. 5 is a side elevational view of a modified rotary cutter having three end-to-end cutter units.

It will be appreciated that more than two cutter units can be used for each cutter assembly 22. For example, referring to FIG. 5, if three cutter units are used rather than two in this case, the preferred staggering locates the leading side of each gullet midway across the width of a land in one of the adjoining cutter units. In FIG. 5, the parts corresponding to those of the two cutter unit embodiments in FIG. 2 have been given the same identifying numerals followed by a prime for convenience of reference.

It will be appreciated that the carbide knives 39 can be repositioned so that each of their four longitudinal edges 39*a* is located in cutting position. Thus, each knife 39 has four alternative cutting edges for use before knife replacement is needed.

I claim:

1. A cutter assembly comprising:

multiple rotary cutter units each having alternating gauge lands and gullets having leading and trailing sides, and each having a cutting knife held in each gullet at the trailing side thereof and presenting an exposed cutting edge;

said cutter units being held in staggered end-for-end relation so that each land controls the depth of cut of the knife in an adjoining gullet in an adjoining cutter unit.

2. A cutter assembly comprising:

multiple rotary cutter units mounted in end-to-end relation for unitary rotation on a rotary axis;

each of said units having a body presenting alternating gauge lands and gullets around its periphery, each land and gullet having a leading and trailing side parallel to said axis;

each of said cutter units also having a knife mounted in each gullet at the trailing side thereof so that the knife has a leading cutting edge;

said cutter units being arranged so that at least a portion of each land is located axially of one of the knives on one of the other cutter units so that the depth of cut of each knife is controlled by one of the lands.

3. A cutter assembly according to claim 2 in which said knives are held in said gullets by wedging keys therein holding the knives against the trailing side of the gullets.

4. A cutter assembly according to claim 3 in which the outer faces of the gauge lands occupy parts of an imaginary cylindrical surface.

5. A cutter assembly comprising:

multiple matching cutter units, each of said units comprising:

a cylindrical body having its outer face interrupted at regular intervals around its circumference by gullets extending parallel to the center axis of said body and having leading and trailing sides defining the trailing and leading sides, respectively, of lands between the gullets, said body being formed in the gullets with outwardly facing seats adjoining the trailing side of the gullets, knives seated on said seats and each having a leading cutting edge adjacent the outer face of said body, and wedging means in said gullets for clamping said seated knives against the trailing side thereof and leaving outwardly exposed gullet zones outwardly of said wedging means in front of said knives;

said cutter units being secured together in staggered end-to-end relation so that the gullets are each endwise of a portion of a land whereby each land functions as a depth gauge for an adjacent knife on one of the other cutter units.

6. A cutter assembly according to claim 5 in which said wedging means comprises wedging keys and bolts forcing said keys toward the bottom of said gullets.

7. In a ring debarker of the type having a rotary ring, radial arms swingably mounted on said ring, a driven stub shaft at the outer end of each arm, and a rotary cutting tool driven by said shaft for removing bark from a log traveling through the ring while the ring is rotating, an improved such tool comprising:

multiple rotary cutter units each having alternating gauge lands and gullets with leading and trailing sides, and each having a cutting knife held in each gullet at the trailing side of the gullets and presenting an exposed cutting edge;

said cutter units being held in staggered end-for-end relation so that each land controls the depth of cut of the knife in an adjoining gullet in an adjoining cutter unit.

* * * * *